United States Patent [19]

Nae-Won

[11] Patent Number: 4,984,586

[45] Date of Patent: Jan. 15, 1991

[54] ASHTRAY HAVING CIGARETTE SNUFFING DEVICE

[76] Inventor: Lee Nae-Won, 6/2,90,Moonhak-Dong, Nam-Ku,Incheon, Rep. of Korea

[21] Appl. No.: 411,993

[22] Filed: Sep. 25, 1989

[51] Int. Cl.[5] ..... A24F 13/18

[52] U.S. Cl. ..... 131/256; 131/235.1; 131/237

[58] Field of Search ..... 131/256, 331, 235.1, 131/236, 237, 237.5

[56] References Cited

U.S. PATENT DOCUMENTS 2,495,496 1/1950 Agee ..... 131/235.1

4,027,683 6/1977 Lawbaugh ..... 131/235.1

*Primary Examiner*—V. Millin

*Attorney, Agent, or Firm*—Beveridge, DeGrandi & Weilacher

[57] ABSTRACT

This invention relates to an ashtray having cigarette snuffing device which has two major parts; one is an ashtray to gather ash and the other is a cigarette snuffing device to extinguish the lighted tip of a cigarette. The cigarette snuffing device provides multiple snuffing tubes in which the lighted end of a cigarette is inserted and it is extinguished for lack of oxygen.

9 Claims, 4 Drawing Sheets

ASHTRAY HAVING CIGARETTE SNUFFING DEVICE

BACKGROUND OF THE INVENTION

This invention relates to an ashtray having cigarette snuffing device.

In the past, in the home and also in public places such as in hotel lobbys and in auditoriums, in automobiles and aircrafts, there is a substantial danger of fire from incompletely distinguished cigarettes in conventional ashtrays. The crushing of cigarettes, which is the usual method of extinction in conventional ashtrays, often leaves smoldering remnants which constitutes a fire danger. A much more effective method of extinction is to pour the water slightly in to ashtrays, but this method is extremely inconvenient. So cigarette snuffers are introduced to solve the above problems.

SUMMARY OF THE INVENTION

The present invention is to remedy inventional disadvantages of cigarette snuffers hitherto before. That is, the object of the present invention is to provide an ashtray having a cigarette snuffing device which is of no danger, and convenient to use.

The proper embodiment of the present invention has two major parts; one is an ashtray to gather ash, and the other is a cigarette snuffing device to extinguish the lighted tip of cigarette. The cigarette snuffing device provides multiple snuffing tubes in which the lighted end of a cigarette is inserted and it is extinguished for lack of oxygen.

DETAILED DESCRIPTION OF THE PRESENT INVENTION

Figure 1:
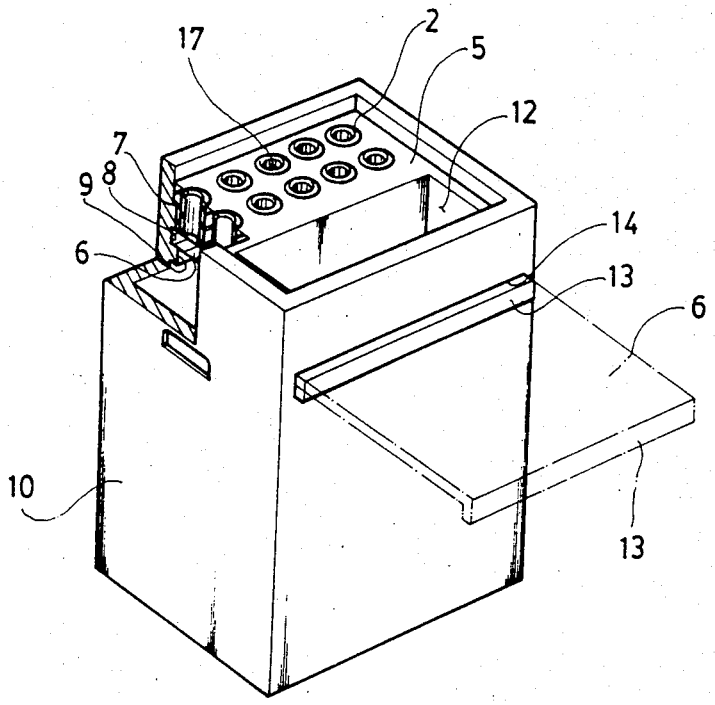
FIG. 1 is a perspective view, partially cut-away, of the present invention showing the ashtray being in use.

As shown in FIG. 1, on the upper part of four walls of a ashtray body 10, there is formed a projection ridge 7 and a supporting projectiong, and between the two elements there formed a inserting groove 8 to which a plate member 6 is inserted through a guide slit 14 which is provided on a wall of the ashtray body 10. A grip 13 provided on one end of the plate member 6 is folded downward. The plate member 6 is slidable through the guide slit 13, and it is able to separate the plate member 6 from the ashtray body 10.

Figure 2:
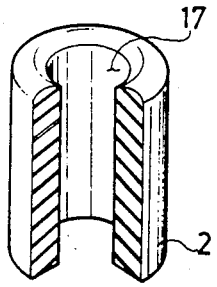
FIG. 2 is a perspective view of the snuffing tube having an open bottom.
Figure 3:
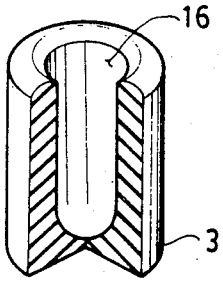
FIG. 3 is a perspective view of the snuffing tube having a closed bottom.
Figure 4:
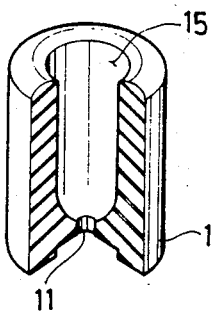
FIG. 4 is a perspective view of the snuffing tube having a small bottom hole.

A member 5 installed upon the plate member 6, has an ash disposal opening 12 and multiple snuffing tubes 2. The bottom of snuffing tubes 2, 3, and 1 is open, closed, or partially open respectively as shown in FIG. 2, 3, and 4. The size of a small bottom hole of a snuffing tube 1 is variable. Below the plate member 6, is an ash receptacle (unshown in FIG.).

Figure 5:
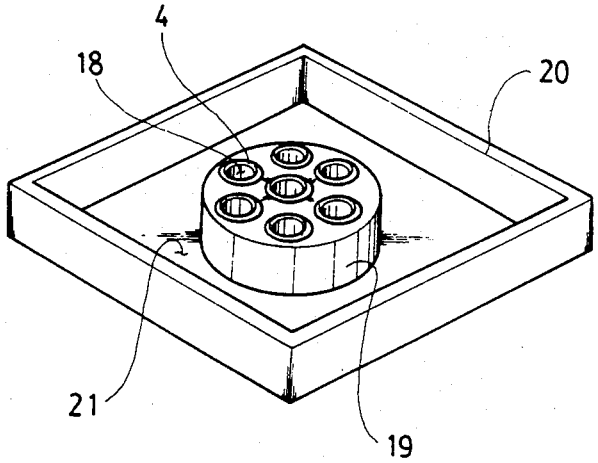
FIG. 5 is another embodiment according to the present invention.

As shown in FIG. 5, another embodiment according to the present invention takes the form of a rectangular ash disposal receptacle 21 which provides a cylindrical member 19 at center. The cylindrical meter 19 has multiple snuffing tubes.

Figure 6:
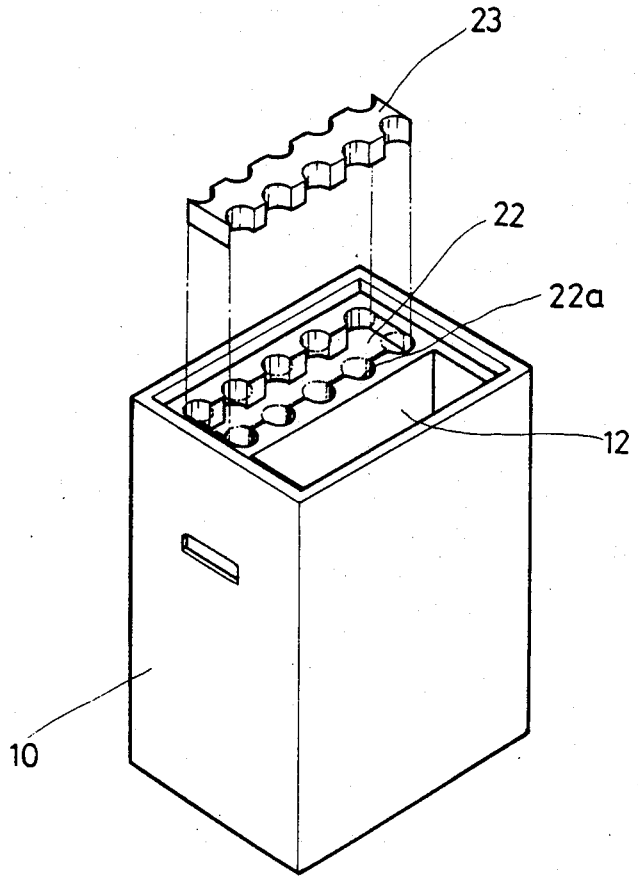
FIG. 6 is another embodiment according to the present invention.
Figure 7:
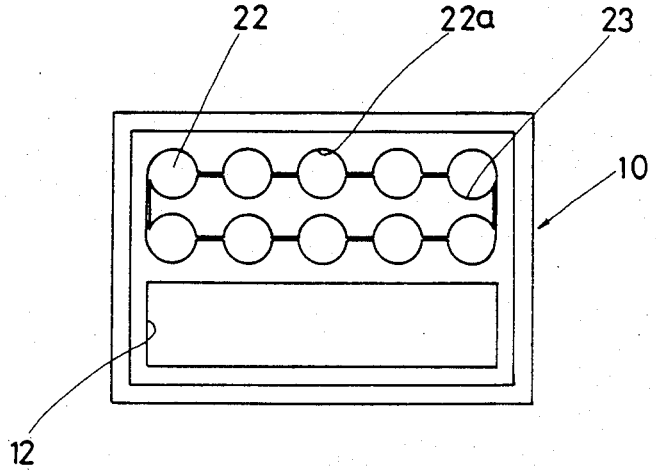
FIG. 7 is a plane view of FIG. 6.

As shown in FIG. 6 and FIG. 7, another embodiment according to the present has a concave 22 with multiple semicircular grooves **22*a* on the upper part of ashtray body 10 which includes multi-semicircular member 23**.

All the snuffing tubes 1, 2, 3 and 4 have cigarette inserting holes 15, 16, 17 and 18 respectively, and the shape of cigarette inserting holes is circular or polygonal.

The effect of the present invention above described is as below.

Ash is disposed into the ash disposal opening 12 when smoking, and a lighted cigarette butt is inserted into a snuffing tube 2 for extinction. Because the bottom of snuffing tubes l, 2, and 3 is closed, or open but nearly contact with the plate member 6, a lighted cigarette butt is extinguished in a few seconds due to lack of oxygen. It is desirable to make snuffing tubes 1, 2 and 3 out of insulating material to prevent snuffing tubes l, 2, and 3 from becoming damaged. For example it will be good to adopt an insulating paper board, a glass wool, or a heat resistant plastic.

After completion of the extinguishing procedure , cigarette butts are transferred manually from snuffing tubes 1, 2, and 3 to the ash disposal opening 12. Stored ash and cigarette butts in the ash disposal opening, and ash in snuffing tubes 1 and 2 which have an open bottom drop to the ash receptacle by pulling the plate member 6 out of the ashtray body 10 through the guide slit 14. In case of a snuffing tube 3 which has a closed bottom, disposal of ash in snuffing tubes 3 is accomplished by taking the member 5 out of the ashtray body 10, and turning it over, and dropping ash in snuffing tubes 3 to the ash receptacle.

In case of another embodiment of the present invention shown in FIG. 5, 6 and 7 all the steps of the extinguishing procedure, and disposing ash and cigarette butts, etc. are the same as the above steps described in the first embodiment.

Member 5 and 20, to be laid upon the plate member 6, is made out of disposable paper material. In case of disposable members it is easier to maintain cleanness and easiness of use.

Modifications of this invention will occur to those skilled in this art. Therefore it is to be understood that this invention is no limited to the particular embodiments disclosed here, but that it is intended to cover all modifications which are within the spirit and scope of this invention as claimed.

What is claimed is:

1. A combination cigarette snuffing device and ashtray, comprising:

an ashtray body having an open top, a closed bottom, and first, second, third, and fourth side walls, said first side wall having an elongated slit formed therein which is at a height that separates an upper portion of said ashtray body from a lower portion of said ashtray body, said second side wall being positioned opposite to said first side wall, and said second side wall having receiving means formed on an interior surface of said second side wall;

a snuffer member affixed to said ashtray body and positioned within the upper portion of said ashtray body, and said snuffer member including at least one snuffer tube; and a plate insertable into said slit and having a forward edge releasably receivable within said receiving means, said plate dimensioned and arranged such that said forward edge is slidable between said first and second side walls, and said plate having a portion which has width which is essentially equal to the distance between said third and fourth side walls and said portion having a length which is sufficient to extend between said first and second side walls such that the lower portion of said ashtray body is essentially sealed off from the upper portion of said ashtray body when the forward edge of said plate is received within said receiving means.

2. A combination as recited in claim 1, wherein said snuffer member includes an ash disposal opening which opens into the bottom portion of said ashtray body when said plate is in a retracted position wherein the forward edge is positioned to one side of both said ash disposal opening and said receiving means.

3. A combination as recite din claim 2 wherein said at least one snuffer tube is formed of a heat insulating material.

4. A combination as recited in claim 3 wherein said snuffer member includes a supporting structure supporting said at least one snuffer tube, and aid supporting structure being formed of a disposable paper material.

5. A combination as recited in claim 1 wherein said snuffer means is releasably attached to said ashtray body and said at least one snuffer tube has an open end and an integrally formed closed end.

6. A combination as recited in claim 1 wherein said snuffer tube has an open end and a partially closed end said partially closed end featuring an aperture having a periphery which is less than said open end, said open end being dimensioned to receive a cigarette, and said partially closed end preventing passage of the cigarette through said tube.

7. A combination as recited in claim 6 wherein said receiving means includes a ridge vertically spaced from a supporting projection to define a longitudinal groove therebetween which is adapted to receive the forward edge of said plate.

8. A combination as recited in claim 1 wherein said receiving means includes a ridge vertically spaced from a supporting projection to define a longitudinal groove therebetween which is adapted to receive the forward edge of said plate.

9. A combination as recited in claim 1 wherein said snuffer member includes a first member having a plurality of concavities formed along an edge, and said snuffer member includes a second member having a plurality of semi-circular grooves, said second member being fixed to said ashtray body and said first member being releasably disposed within an opening formed in said second member in a manner which aligns said concavities with said semi-circular grooves so as to form a plurality of snuffer tubes.

* * * * *